US006715728B2

(12) United States Patent
Nielsen

(10) Patent No.: US 6,715,728 B2
(45) Date of Patent: Apr. 6, 2004

(54) DUMBBELL SUPPORT DEVICE AND SYSTEM FOR USING THE SAME

(76) Inventor: Peter Nielsen, 7327 N. McKinley Ave., Kansas City, MO (US) 64158

( * ) Notice: Subject to any disclaimer, the term of this patent is extended or adjusted under 35 U.S.C. 154(b) by 0 days.

(21) Appl. No.: 10/217,881

(22) Filed: Aug. 13, 2002

(65) Prior Publication Data

US 2002/0190177 A1 Dec. 19, 2002

Related U.S. Application Data

(63) Continuation-in-part of application No. 09/872,973, filed on Jun. 1, 2001, now abandoned.

(51) Int. Cl.[7] ..... B42F 13/00

(52) U.S. Cl. ..... 248/339; 248/302; 248/303; 248/340; 224/268; 482/104; 482/106; 482/108

(58) Field of Search ..... 248/339, 340, 248/690, 303, 302; 482/109, 108, 93, 105, 106, 104, 94, 95, 96; 224/268, 68, 69, 666; 211/60.1, 85.7

(56) References Cited

U.S. PATENT DOCUMENTS 3,235,255 A * 2/1966 Leflar ..... 272/81
4,391,397 A * 7/1983 Taylor, Jr. ..... 224/265
D275,527 S * 9/1984 Gee ..... D2/400
4,484,740 A * 11/1984 Green ..... 482/105
4,607,840 A * 8/1986 Harper ..... 482/109
4,715,293 A * 12/1987 Cobbs ..... 106/43
4,768,780 A * 9/1988 Hayes ..... 482/108
4,955,604 A * 9/1990 Pogue ..... 272/123
4,973,050 A * 11/1990 Santoro et al. ..... 482/102
4,988,091 A * 1/1991 Schaefer ..... 482/105
5,169,364 A * 12/1992 Donaldson ..... 482/105
5,222,641 A * 6/1993 Medeiros, Jr. ..... 224/161
5,281,192 A * 1/1994 Nelson ..... 482/93
5,292,044 A * 3/1994 Reimers ..... 224/264
5,540,640 A * 7/1996 Povilaitis ..... 482/108
5,573,484 A * 11/1996 Carpenter ..... 482/108
5,651,758 A * 7/1997 Cervantes ..... 482/93
5,967,949 A * 10/1999 Davenport ..... 482/93
5,971,339 A * 10/1999 Falasco, Jr. ..... 248/339
6,001,049 A * 12/1999 Frey ..... 482/105
6,029,830 A * 2/2000 Manookian ..... 211/87.01
6,436,016 B1 * 8/2002 Valentino ..... 482/108
6,471,105 B1 * 10/2002 Ammerman et al. ..... 224/625

OTHER PUBLICATIONS

US 2002/0072455 to Akins, Cushion Disposed on Weight-lifting Bar, Jun. 2002.*

* cited by examiner

*Primary Examiner*—Ramon O. Ramirez
*Assistant Examiner*—Amy J. Sterling

(57) ABSTRACT

The present invention relates to a dumbbell support device which can be hung from the crossbar of a weight rack or from a weight belt and a system for using the device. One end of the device can hang over the crossbar of a weight rack, while the opposite end, which includes a non-slip strap, can receive the dumbbell. The device consists of a frame having two S-shaped members, a perpendicular bar member attaching said S-shaped members, and a non-slip strap located parallel to the perpendicular bar member and perpendicular to the S-shaped members and removably attached to one end of the S-shaped members. The device can include a weight belt having at least one unitary J-shaped member, to which the device may be attached, along with a weight rack having an adjustable crossbar and a floor plate.

2 Claims, 8 Drawing Sheets

DUMBBELL SUPPORT DEVICE AND SYSTEM FOR USING THE SAME

This application is a continuation-in-part of patent application Ser. No. 09/872,973, filed on Jun. 1, 2001 now abandoned.

FIELD OF INVENTION

The present invention relates to a device for use with exercise equipment and, more particularly, to a device for supporting a dumbbell which can also be used with a weight belt or a weight rack.

BACKGROUND OF INVENTION

Weightlifting has become a popular exercise. More people are incorporating a weightlifting routine into their exercise regimen in order to build strength and stamina. Weightlifting has also been shown to increase a person's metabolism, and could help in the prevention of osteoporosis. Various athletes rely on weightlifting to help increase their physical abilities. Many doctors prescribe weight training for their patients in order to allow the patients to regain their strength, stamina, and coordination after injury and/or surgery.

Some weightlifting exercises require the use of a weight bench and rack, such as a flat, incline, decline, or military press bench. Dumbbells are used with these devices to perform various exercises. Routinely, the dumbbell required for performing these exercises is heavier than what can be lifted from the floor when a person is in position to perform the exercise on a weight bench. This means the weightlifter must wait for a spotter to hand him or her the dumbbell. Even if the weightlifter can lift the dumbbell off the floor from his or her prone position, it will be necessary for him or her to bend awkwardly from the weight bench in order to raise the dumbbell to start exercising and, again, at the end of the routine, to return the dumbbell to the floor. This increases the risk of injury when lifting weights. The weightlifter could easily pull, strain, or tear a muscle, injure his or her back, and/or smash his or her fingers.

It is desirable to have a device that will support a dumbbell on a weight bench so that the weightlifter does not need to risk injury or wait for a spotter in order to perform his or her exercise routine. This device should also be convenient to use so that it does not cause undue delay in the weightlifter's exercise routine.

It is also desirable to have a weight belt to which the device can be attached so that the weightlifter can isolate leg muscles during lower body exercises, such as squats, without having to hold the weights. By not having to hold the weights, the weightlifter can lift heavier dumbbells using his or her leg muscles without putting stress on upper body, arm, and shoulder muscles which are generally less developed and more prone to injury, especially the rotator cuff muscles.

SUMMARY OF INVENTION

The present invention relates to a dumbbell support device designed to support dumbbells of various weights on a weight bench and rack and a system for using the device. The device can hang from any substantially horizontal member, such as the crossbar of a weight bench rack.

The device is comprised of a frame having two S-shaped members parallel to each other, attached to one another by a perpendicular bar member. The location of the perpendicular bar member is such that it is positioned to add stability to the frame. In one embodiment of the present invention, the perpendicular bar member is positioned at one end of the two S-shaped members, in order to create a U-shape.

The device further includes a non-slip strap generally parallel to the perpendicular bar member, and perpendicular to the S-shaped members. The non-slip strap is preferably located at one end of the S-shaped members. The non-slip strap can be removably attached to the S-shaped members by any means familiar in the art, including having a non-slip strap with a tube at each end so that the tubes slide over the ends of the S-shaped members. Other means of removably attaching the non-slip strap may include the use of permanently affixed snaps, hook and loop attachments, stitched ends, sealed ends, bonded ends, zippers, or any combination thereof. Further, the non-slip strap can be a seamless tube stretched over one end of each S-shaped member.

In another embodiment, the device includes a second strap removably attached to the S-shaped members. The second strap is generally parallel to the perpendicular bar member, and perpendicular to the S-shaped members. The second strap is preferably removably attached to the straight portion of each S-shaped member and is parallel to the perpendicular bar member. The second strap can be removably attached to the frame by any means familiar in the art, including having a strap with a tube at each end so that the tubes slide over the ends of the S-shaped members. Other means of removably attaching the second strap may include the use of permanently affixed snaps, hook and loop attachments, stitched ends, sealed ends, bonded ends, zippers, or any combination thereof. Further, the strap can be a seamless tube stretched over one end of each of the S-shaped members. Once on the ends of the S-shaped members, the strap is then slid up the S-shaped members so that it lies across the straight portion of the two S-shaped members.

The device can include a cushion, which encapsulates the perpendicular bar member. The cushion can be a continuous tube fixedly attached to the perpendicular bar member. Optionally the cushion can be removably attached to the perpendicular bar member with a slit running the entire length of the cushion parallel to the perpendicular bar member. Preferably, the cushion consists of padding material wrapped around the perpendicular bar member and on top of itself. The cushion may consist of any durable padding material including foam, cloth, rubber, leather, sponge, neoprene, latex, or any combination thereof.

In a further embodiment, the device can include a non-slip band looped around the perpendicular bar member so that it lies perpendicular to the perpendicular bar member, and parallel to the S-shaped members. This non-slip band can be removably attached to the perpendicular bar member by any means familiar in the art. The ends of the band can be fastened using hook and loop attachments, permanently affixed snaps, stitched ends, sealed ends, bonded ends, buckles, snap-hooks, zippers, or any combination thereof. Optionally, the non-slip band may be fixedly attached to the perpendicular bar member. The non-slip band can be made of any strong and durable material, such as leather, nylon, rubber, cloth, or combinations thereof.

The simple construction of the device allows it to hang from a crossbar of a weight bench and rack by placing the end of the S-shaped members opposite the end having the non-slip strap attached to it, over the crossbar. The dumbbell can than be placed across the non-slip strap at the other end of the S-shaped members. This allows the curved portion at that end of the S-shaped members to support the dumbbell.

The material used for the non-slip strap should be lightweight and thin, so that the weightlifter can easily grasp the non-slip strap along with the dumbbell during his or her weightlifting routine. When not in use, the device can be stored by hanging it from the crossbar of the weight rack. Further, the device can be used with the weight rack separated apart from the weight bench. The device can be placed over the crossbar of the weight rack to allow for storage of the device and for ease in changing the dumbbell held by the device. The weight rack can include a floor plate removably attached to the bottom of the weight rack. A weight lifter will stand on the floor plate of the weight rack and lift the device off of the crossbar of the weight rack. The weightlifter will hold the dumbbell device at his or her side and perform squats while standing on the floor plate.

The dumbbell support device may be attached to a weight belt to increase resistance during exercises. Any weight belt may be used, as long as the device can be attached and hung therefrom. The device hangs from the side of the weight belt such that when the belt is fastened around a weightlifter, the device is positioned on one side of the weightlifter's waist. Therefore, when two devices are attached to the weight belt, the devices are positioned so that one device is on each side of the weightlifter. Generally for balance purposes, two devices should be placed on the weight belt.

The device can be attached to the weight belt by placing the non-slip band of the device around the weight belt and positioning the device so that it hangs from one side of the weightlifter when the weight belt is worn. When using the non-slip band, any standard weight belt may be used as long as the non-slip band can fit around the weight belt and be positioned on the side of the weight belt. Preferably the device is removably attached to a weight belt having at least one unitary J-shaped member attached to the outer sides of the weight belt from which the device can hang securely. The J-shaped member can be fixedly or removably attached to the weight belt. The perpendicular bar member of the device fits in the J-shaped member so that the device hangs from the J-shaped member of the weight belt. A dumbbell is then placed in the device.

An advantage of the present invention is that the dumbbells are placed in the device without the use of clamps, latches, or locking mechanisms. This allows the weightlifter to quickly and easily switch dumbbells. After lying down on the bench, the weightlifter can easily grasp the device and the dumbbell and begin performing his or her weightlifting set. At the end of the set, the dumbbell can be lifted out of the device and replaced with a lighter or heavier dumbbell, in order to allow the weightlifter to quickly return to his or her exercise routine. Another advantage of this design is that no disassembly of the weight bench and rack is required. Also, because the device is capable of hanging from any substantially horizontal member, it is not limited to use with a weight bench. The weight rack can be used in conjunction with any flat apparatus which could be used as a bench so long as the crossbar of the weight rack is adjusted to a height which allows the dumbbell device to freely hang from the crossbar and be grasped by the weightlifter when in a prone position. When attached to a weight belt, the device aids in leg exercises such as lunges and squats by taking all stress off of the upper body, shoulders, and arms thereby isolating lower body and leg muscles.

A further advantage is that the device can be used with the preferred weight belt and weight rack to form a weightlifting system in which the device can easily and quickly be placed in the unitary J-shaped member of the preferred weight belt to add extra weight to the lower body while performing lunges and squats and then easily removed and hung on the crossbar of the weight rack for easy storage.

DETAILED DESCRIPTION

The present invention relates to a dumbbell support device and system of use. This device is designed to support dumbbells of various weights on a weight bench. Disassembly of the weight bench and rack is not required in order to use the present invention, as the device can be placed directly on the crossbar of the rack of the weight bench. The device can hang from any substantially horizontal member and, therefore, is not limited for use only with a weight bench and rack. One embodiment of the invention includes a weight belt to which the device may be attached. A further embodiment includes a weight rack having a removable crossbar to which the device can be attached and a removable floor plate.

Figure 1:
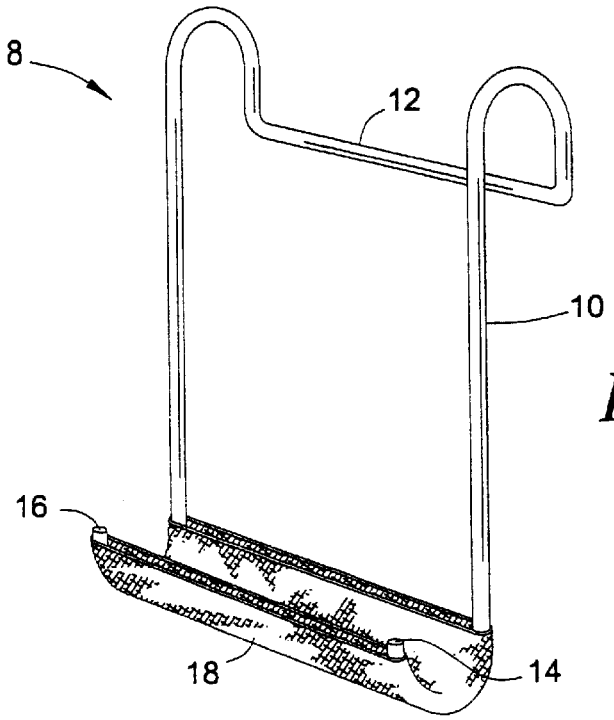
FIG. 1 is a perspective view of the dumbbell support device.

Referring now to the drawings, FIG. 1, the device 8, includes a frame 10, with two S-shaped members 14 and 16, which are parallel to each other. The S-shaped members 14 and 16 may be curved, rounded, squared, or any combination thereof. The S-shaped members 14 and 16 are attached to one another by a perpendicular bar member 12. These S-shaped members 14 and 16 can be either removably attached to one another, or, preferably, integrally attached to one another by the perpendicular bar member 12. FIGS. 1–5 show one embodiment of the invention, wherein the perpendicular bar member 12 is positioned at one end of the S-shaped members 14 and 16, thereby creating a U-shape. In other embodiments of the present invention, the perpendicular bar member 12 may be positioned anywhere along the S-shaped members 14 and 16, as long as it adds stability to the frame 10.

The device 8 further includes a non-slip strap 18, which is located perpendicular to the S-shaped members 14 and 16 and generally parallel to the perpendicular bar member 12. The non-slip strap 18 is removably attached to one end of the S-shaped members 14 and 16. In the embodiment of the invention where the perpendicular bar member 12 is placed at one end of the S-shaped members 14 and 16 to form a U-shape, the non-slip strap 18 is located parallel to the perpendicular bar member 12, at the opposite end of the S-shaped members 14 and 16.

The non-slip strap 18 can be attached by various means known in the art. In the embodiment shown in FIG. 1, the non-slip strap 18 is a seamless tube stretched across and over one end of each of the S-shaped members 14 and 16. The non-slip strap 18 can also be removably attached by having a tube at each end of the strap, so that the tubes slide over the ends of the S-shaped members of the frame, snaps permanently affixed to either end of the non-slip strap, hook and loop attachments at the ends of the strap, stitching the ends, sealing the ends, and/or bonding the ends of the strap over one end of the S-shaped members 14 and 16. The non-slip strap can be made of any material, such as leather, nylon, rubber, cloth, and/or combinations thereof. The material used for the non-slip strap should be lightweight and thin, so that the weightlifter can easily grasp both the non-slip strap and the weight during his or her weightlifting routine.

The frame 10 of the device can be constructed of any rigid material of sufficient strength to hold the dumbbell, such as steel, stainless steel, aluminum, titanium, and/or combinations thereof. Frames made of these materials are strong enough to handle dumbbells of various weights.

Figure 2:
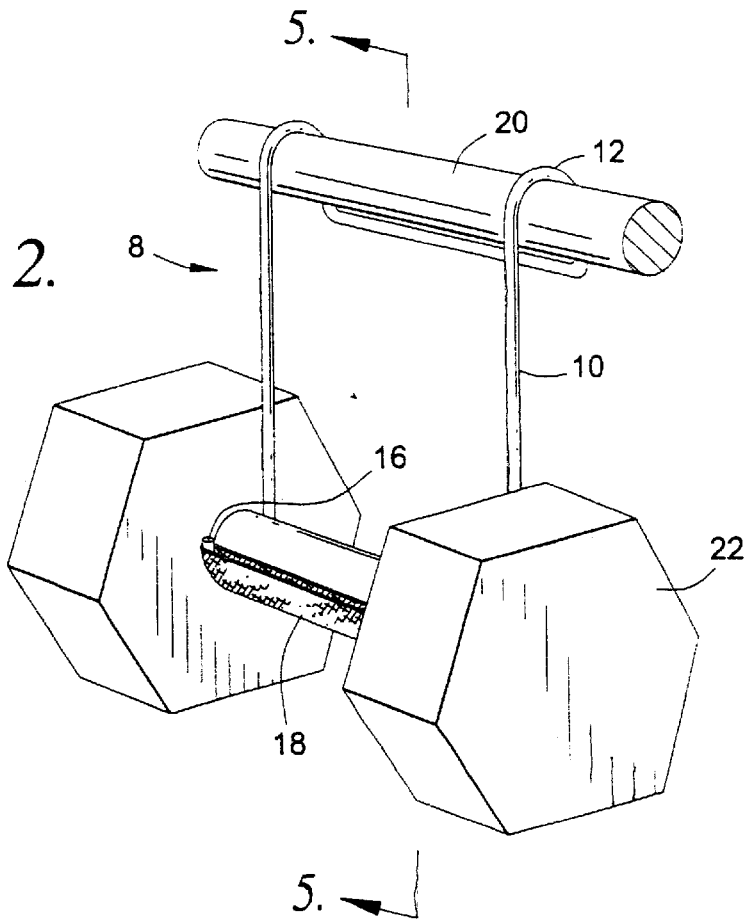
FIG. 2 is a perspective view of the device as it hangs from a crossbar of a weight bench, with a dumbbell placed in the device.
Figure 3:
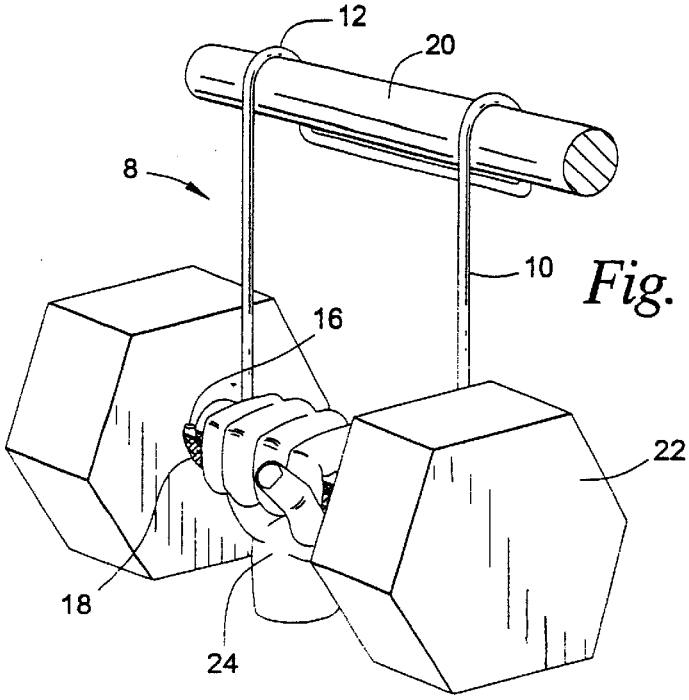
FIG. 3 is the same view as FIG. 2, further demonstrating how a weightlifter grasps the device along with a dumbbell.
Figure 5:
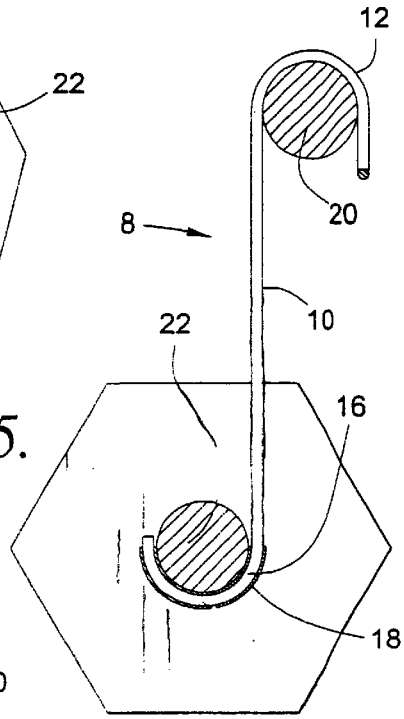
FIG. 5 is a cross sectional view taken on Line 5—5 of FIG. 2.
Figure 4:
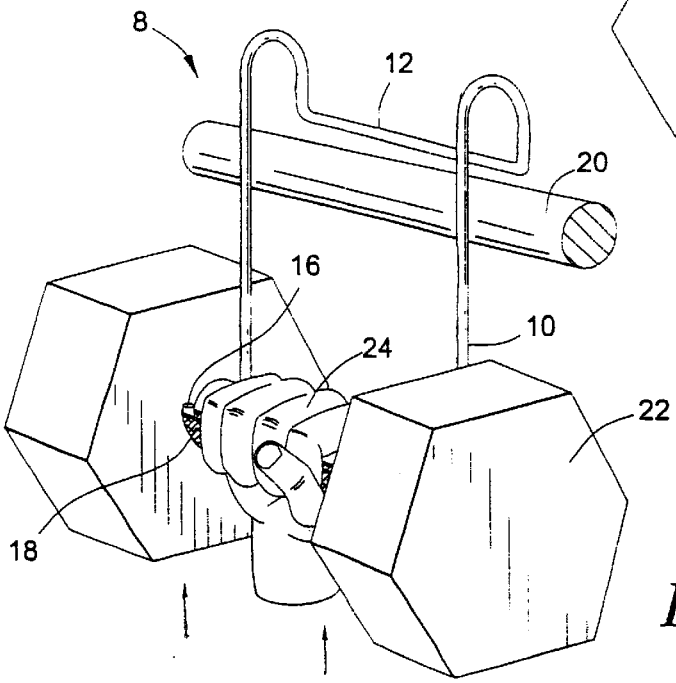
FIG. 4 is a perspective view of the device demonstrating the weightlifter lifting the device and a dumbbell off of the crossbar of a weight bench.

A dumbbell 22 can be placed across the non-slip strap 18 and supported by the S-shaped members 14 and 16, shown in FIGS. 2 and 5. The S-shaped members 14 and 16 will hold a dumbbell 22 in place on the device 8 without the need for a clamp, a latch, or a locking assembly to hold the dumbbell in place. This makes it very easy for the weightlifter to change the dumbbell at the end of his or her sets without unduly disrupting his or her routine.

In order to use the device 8, the end of the S-shaped members 14 and 16 opposite the non-slip strap 18 is hung from a cross bar 20 of a weight bench and rack by placing the end over the crossbar 20 of the rack. A dumbbell 22 can then be placed across bar the non-slip strap 18, and held in place by the S-shaped members 14 and 16. After placing the dumbbell 22 in the device 8 hanging on the cross bar 20, the weightlifter lays on the weight bench and then reaching up, places his or her palm against the strap 18 of the device 8 and closes his or her fingers 24 around the center of the dumbbell 22, shown in FIG. 3. The weightlifter can then lift the dumbbell 22 and the device, shown in FIG. 4, off of the crossbar 20 of the rack, and perform the necessary lifts for his or her training routine. When finished with the exercises, the weightlifter simply places the end of the S-shaped members 14 and 16 opposite the non-slip strap 18 back over the crossbar 20. At the end of a set, the dumbbell can be easily removed from the device and replaced with a heavier or lighter dumbbell, in order to continue the exercise session.

Figure 6:
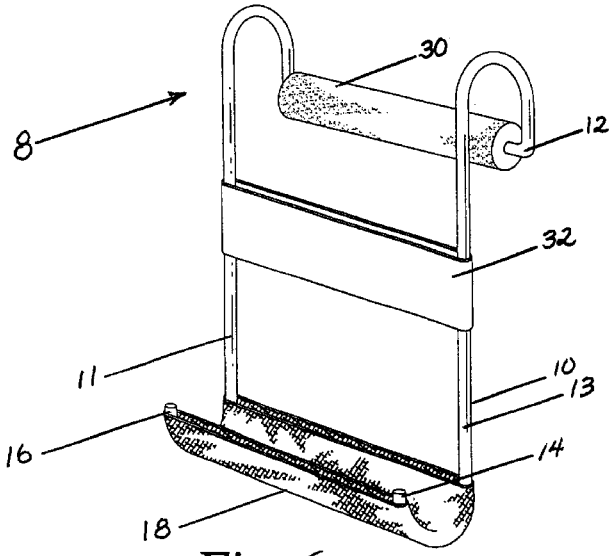
FIG. 6 is a perspective view of the dumbbell support device including a cushion and a second strap.

Another embodiment of the device 8, shown in FIG. 6 includes a second strap 32 removably attached to each of the parallel S-shaped members 14 and 16 and generally parallel to the perpendicular bar member 12 and perpendicular to the S-shaped members 14 and 16. The second strap 32 is preferably removably attached to the straight portion 11 and 13 of each S-shaped member 14 and 16. The strap 32 can be removably attached to the S-shaped members 14 and 16 by any means familiar in the art, including having a slidable strap with a tube at each end so that the tubes slide over the ends of the S-shaped members 14 and 16. Other means of removably attaching the slidable strap 32 include the use of permanently affixed snaps, hook and loop attachments, stitched ends, sealed ends, bonded ends, buckles, snap-hooks, zippers, or combinations thereof. Further, the slidable strap 32 can be a seamless tube and stretched over one end of each of the S-shaped members 14 and 16, and then slid into place across the straight portions 11 and 13 of each S-shaped member 14 and 16.

Figure 7:
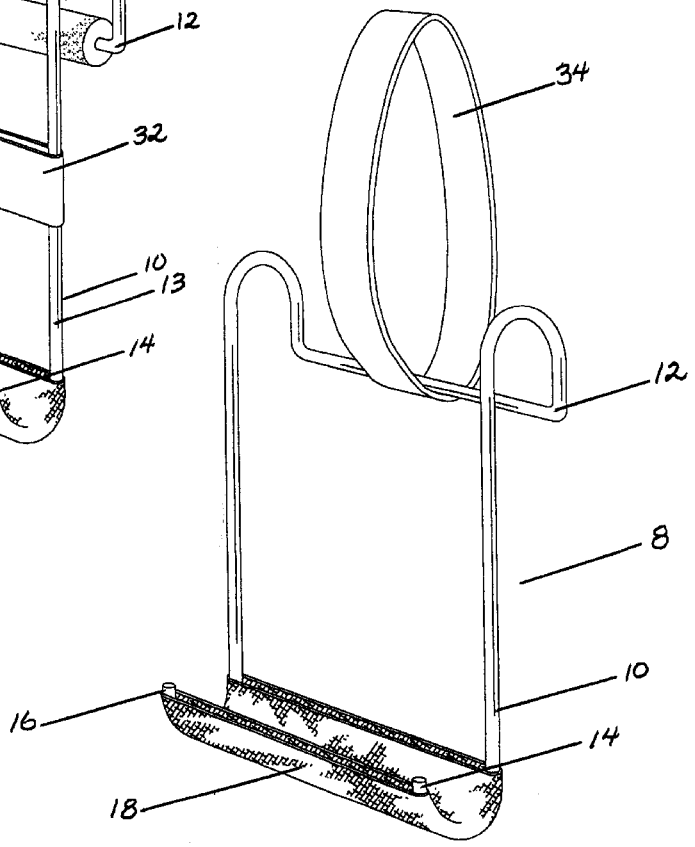
FIG. 7 is a perspective view of the dumbbell support device including a non-slip band looped around the perpendicular bar member and parallel to the S-shaped members.

A further embodiment of the device 8, shown in FIG. 7 includes a non-slip band 34 looped around the perpendicular bar member 12, and parallel to the S-shaped members 14 and 16. The non-slip band 34 can be removably attached to the perpendicular bar member 12 by any means familiar in the art, including the use of permanently affixed snaps, stitched ends, sealed ends, bonded ends, hook and loop attachments, buckles, snap-hooks, zippers, or any combination thereof. Optionally the non-slip band 34 may be fixedly attached to the perpendicular bar member 12. The non-slip band 34 can be made of any strong and durable material, such as leather, nylon, rubber, cloth, or combinations thereof.

During typical use of the device 8, no spotting is required. However, because many weightlifters use spotters to increase the effectiveness of their exercise, maximizing resistance throughout the exercise motion and allowing the lifter to continue to point of muscular failure, if a spotter is used, he or she can hold onto the non-slip band 34 so that assistance may be provided to the lifter when the lifter can no longer lift the dumbbell on his or her own. When the lifter does not need assistance, the non-slip band 34 will remain slack so that maximum resistance to the lifter's lifting movement is achieved at all times. When the weightlifter requires assistance lifting the dumbbell, the spotter can pull the non-slip band 34 taut, eliminating slack and assisting in lifting the dumbbell.

Figure 8:
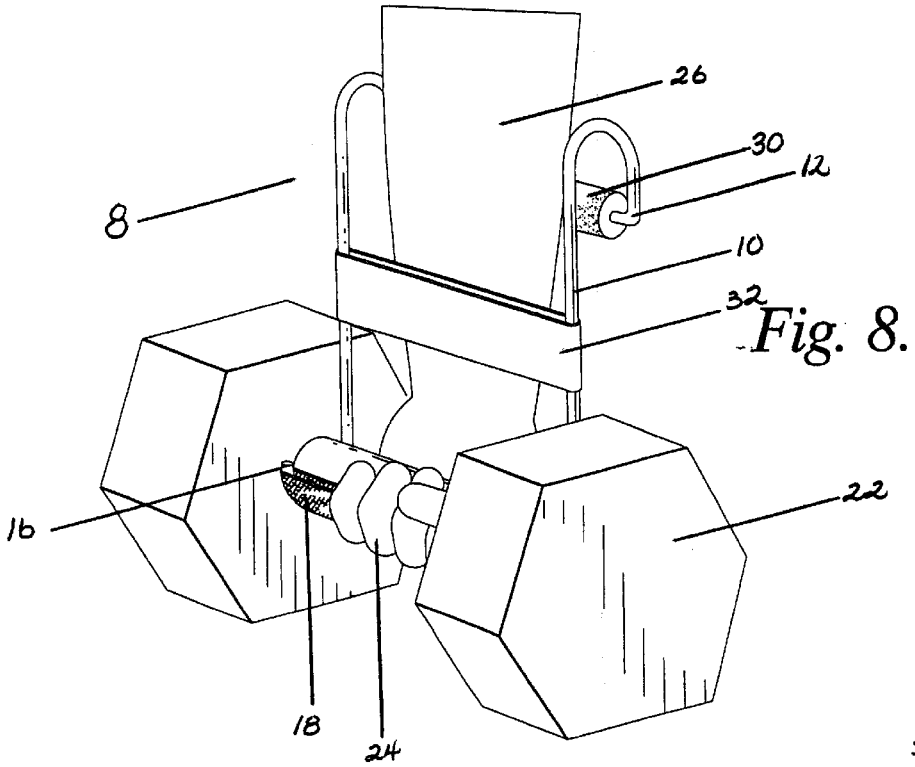
FIG. 8 is a perspective view of the dumbbell support device including a cushion and a second strap further demonstrating how a weightlifter grasps the device along with a dumbbell.

The device may further include a cushion 30, shown in FIG. 8, which encapsulates the perpendicular bar member 12. The cushion 30 can be a continuous tube fixedly attached to the perpendicular bar member 12. Optionally the cushion 30 can be removably attached to the perpendicular bar member 12, having a slit running lengthwise along the cushion, parallel to the perpendicular bar member 12. The slit allows the cushion 30 to be removably wrapped around the perpendicular bar member 12. A thin adhesive film may be wrapped around the inside of the cushion 30 to stabilize the cushion 30 on the perpendicular bar member 12. Preferably, the cushion 30 consists of cushion material wrapped around the perpendicular bar member 12. The cushion material can consist of any durable padding material including foam, cloth, rubber, leather, sponge, neoprene, latex, or any combination thereof.

The cushion 30 provides padding so that a weightlifter can brace his or her forearm 26 against the perpendicular bar member 12 and the second slidable strap 32 while gripping both the dumbbell 22 and the non-slip strap 18 with his or her fingers 24. Such bracing allows the lifter to isolate upper arm and shoulder muscles by stabilizing the wrist and forearm without the need for a wrist-wrap or wrist brace. Typical exercises using this bracing technique include such movements as bicep curl, butterfly press, reverse butterfly, chest press, and tricep extensions.

Figure 9:
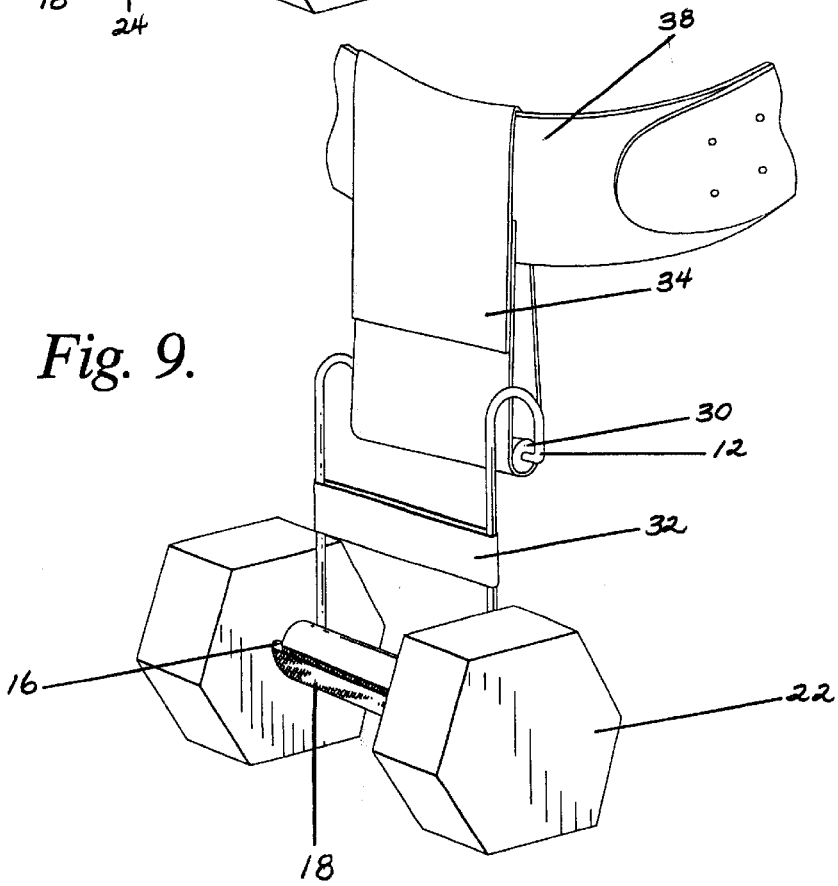
FIG. 9 is a perspective view of the dumbbell support device including a cushion, a second strap, and a band looped around the perpendicular bar member, further indicating how the device along with a dumbbell can hang from a weight belt.
Figure 10:
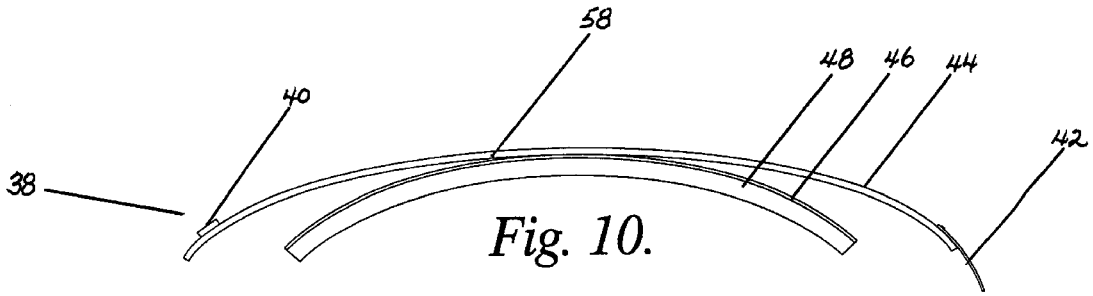
FIG. 10 is a top view of a weight belt which can be used with the dumbbell support device.
Figure 11:
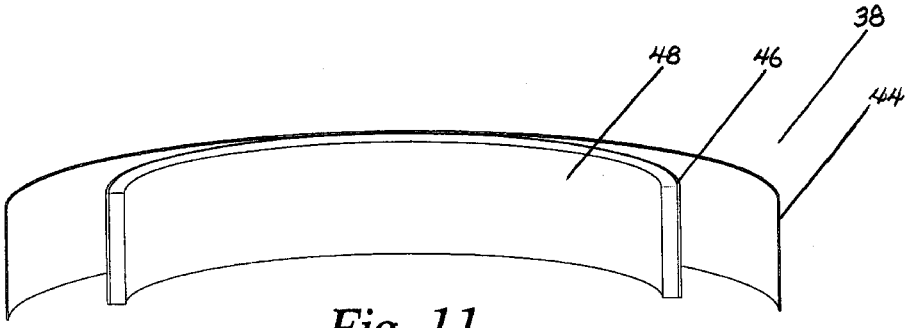
FIG. 11 is a perspective view of a weight belt which can be used with the dumbbell support device.

A member to be used with the device 8 includes a weight belt 38, shown in FIG. 9, to which the device 8 may be fixedly or removably attached. Attachment can be accomplished by way of the non-slip band 34. Any weight belt may be used, as long as the device and a dumbbell can be supported and hang freely from the weight belt when in use shown in FIGS. 7, 9, and 13.

Figure 13:
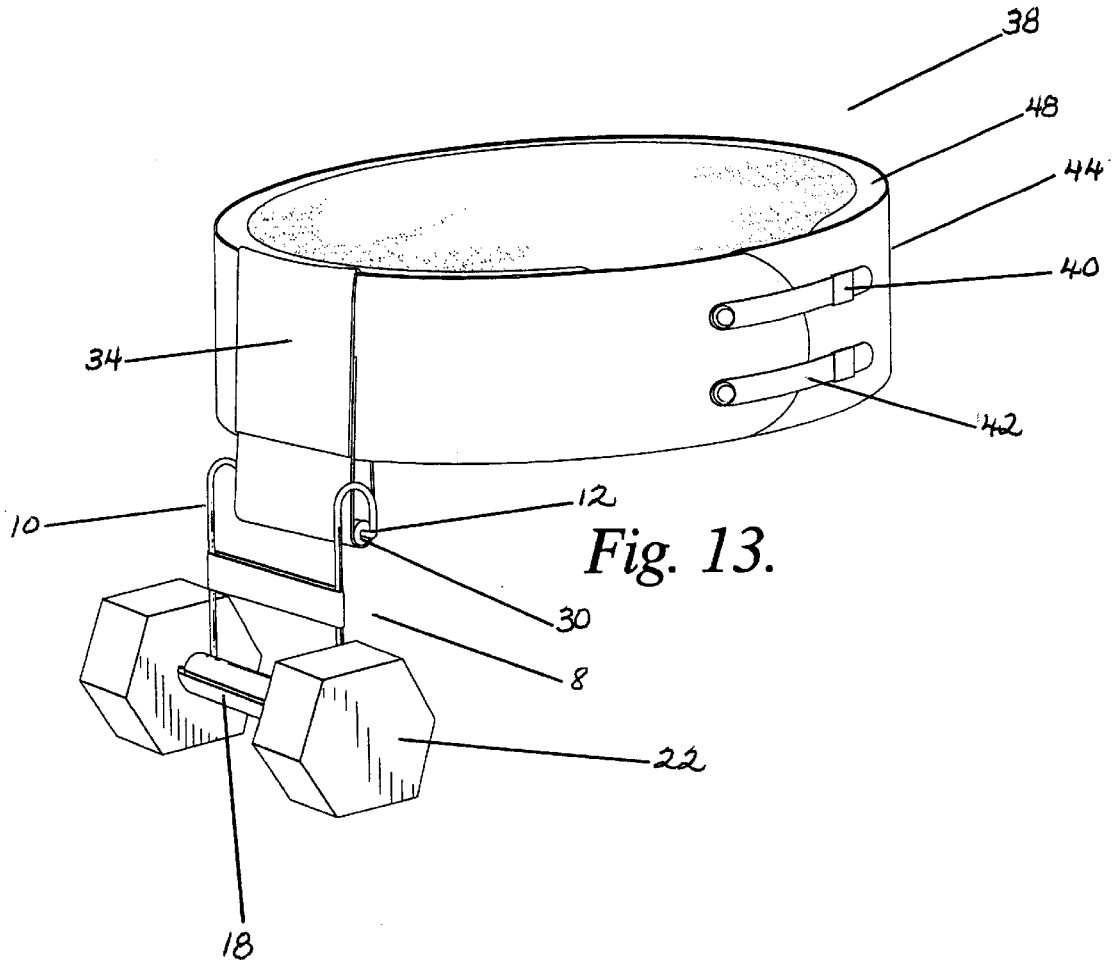
FIG. 13 is a perspective view of a weight belt which can be used with the dumbbell support device, further indicating how the device along with a dumbbell can hang from the weight belt via a non-slip band.

The device can be removably attached to the weight belt by the non-slip band 34. The non-slip band 34 is slipped around the weight belt so that the device hangs from the side of the lifter's waist, as shown in FIGS. 9 and 13. For balance, generally one device 8 hangs from each side of the lifter's waist. Optionally, more than two devices may be used with the weight belt 38.

Figure 12:
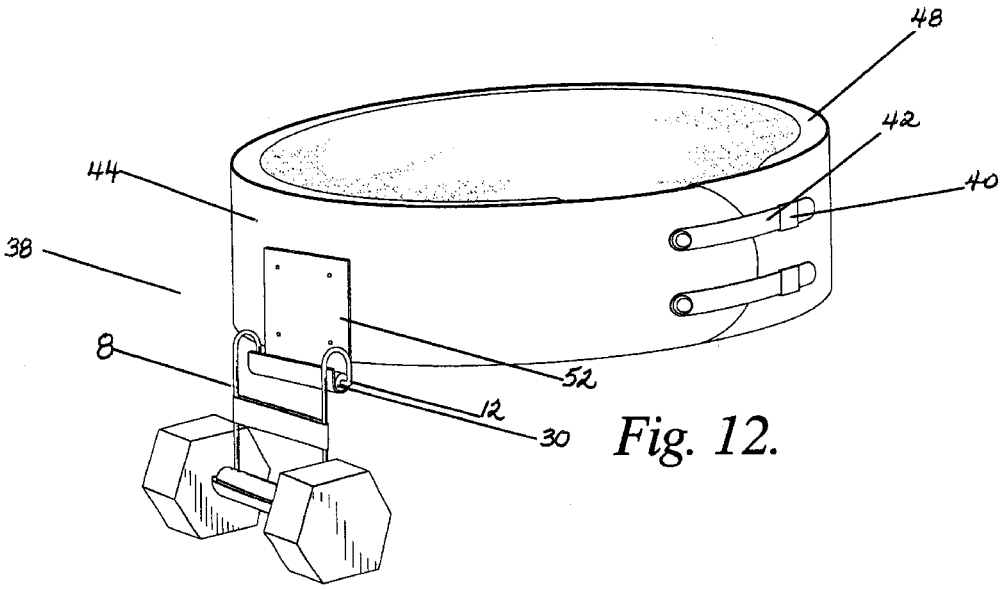
FIG. 12 is a perspective view of a weight belt, including a unitary J-shaped member, which can be used with the dumbbell support device, further indicating how the device along with a dumbbell can hang from the unitary J-shaped member of the weight belt.

In an alternative embodiment, a preferred weight belt 38 has at least one unitary J-shaped member 52 attached to the weight belt. The device 8 can hang securely from the J-shaped member 52. The perpendicular bar member 12 of the device 8 fits in the J-shaped member 52, so that the device 8 hangs on the weight belt 38, as shown in FIG. 12. The J-shaped member 52 can be constructed of any rigid material having sufficient strength to hold the device and dumbbell, such as steel, stainless steel, aluminum, titanium, plastic, and/or combinations thereof. The J-shaped member 52 can be fixedly or removably attached to the weight belt 38 by any means known in the art.

The preferred weight belt 38, shown in FIGS. 10–13 consists of an outer belt 44 attached to an inner belt 46. The inner belt 46 and outer belt 44 are preferably attached at a mid-point 58 so that when the weight belt 38 is worn by a weightlifter, the inner surface of the outer belt 44 conforms to the outer surface of the inner belt 46. The outer belt 44 and inner belt 46 are preferably constructed of plastic, but may also be made of other materials such as leather, nylon, cloth, and combinations thereof. The inner surface of the inner belt 46 includes a non-slip padding 48 giving protection to the weightlifter as well as keeping the weight belt 38 in place when the weight belt 38 is worn by the lifter. Preferably the non-slip padding 48 consists of foam, cotton, cloth, rubber, leather, sponge, neoprene, latex, or any combination thereof. However, any padding may be used so long as it helps keep the belt in place when worn by the weightlifter and provides cushioning. The weight belt 38 consists of an outer belt 44 and an inner belt 46 so that the non-slip band 34 of the device 8 can be easily looped around the outer belt 44. Once the weight belt 38 is placed on the weightlifter and attached, the outer belt 44 and the inner belt 46 hold the non-slip band in place for added stability.

When the belt is worn by the weightlifter, the two free ends of the weight belt 38 are connected by an attachment mechanism. Any form of attachment known in the art is acceptable, including hook and loop attachments, buckles, hooks, zippers, permanently affixed snaps, a ratchet based locking system, or any combination thereof.

With a dumbbell 22, shown in FIGS. 12 and 13 attached to the weight belt 38 using the device 8, the weightlifter can isolate leg muscles in his or her exercise routine during lower body exercises such as squats or lunges without having to hold a dumbbell 22 with his or her hands. The lunges or squats are performed by any means familiar in the art, but with the dumbbell support device 8 and the dumbbells 22 attached to the weight belt 38.

Figure 14:
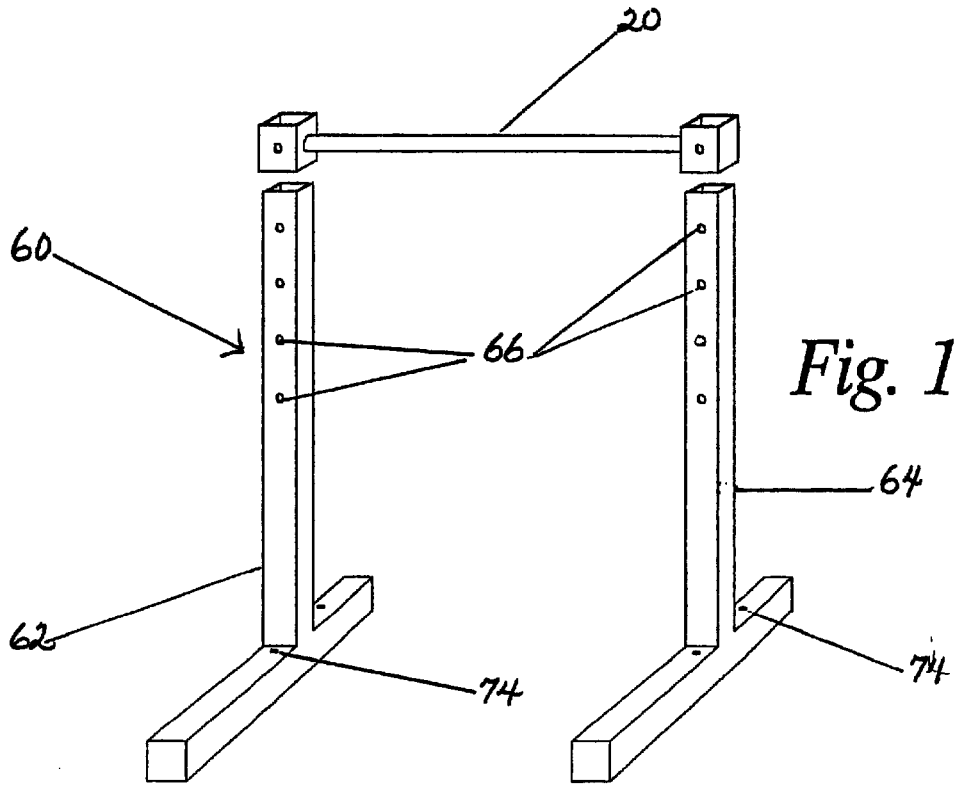
FIG. 14 is a perspective view of the weight rack of the present invention, indicating how the crossbar can be removed from the weight rack.
Figure 15:
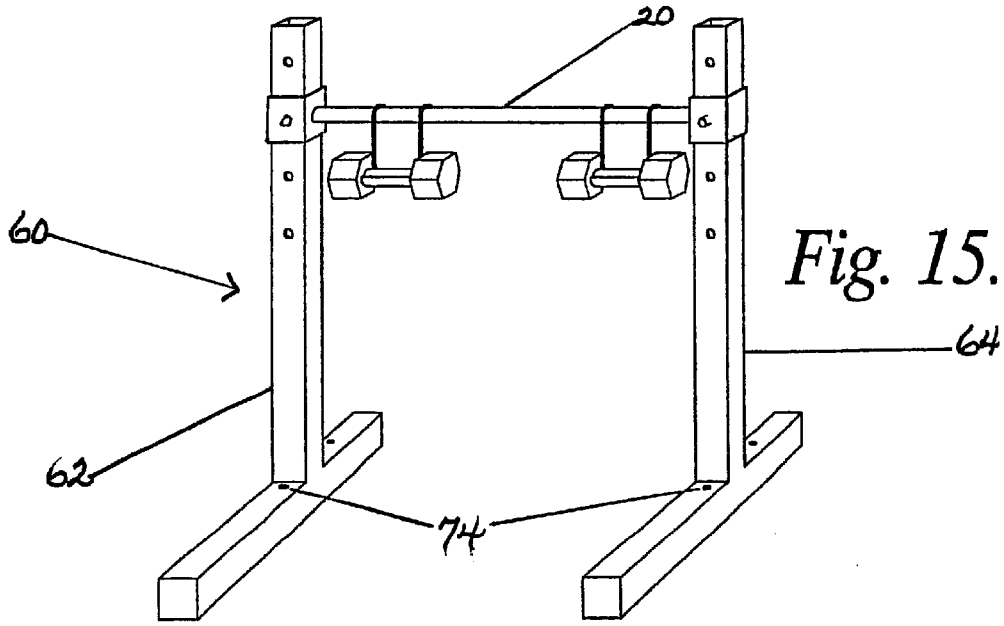
FIG. 15 is a perspective view of the weight rack of the present invention, showing the crossbar in place on the sides of the rack and two dumbbell devices hanging from the crossbar.
Figure 16:
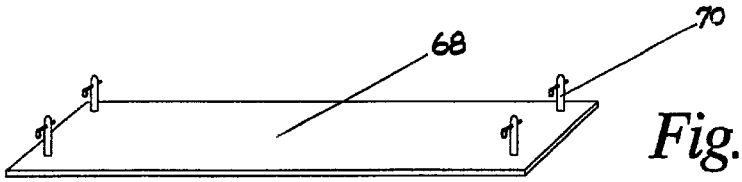
FIG. 16 is a perspective view of the floor plate of the present invention.
Figure 17:
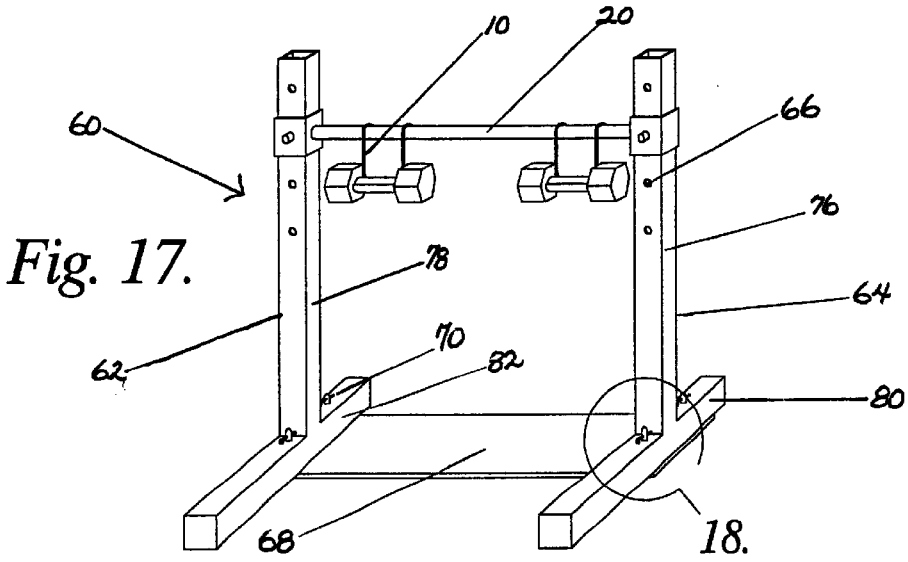
FIG. 17 is a perspective view of the weight rack with the floor plate attached.
Figure 18:
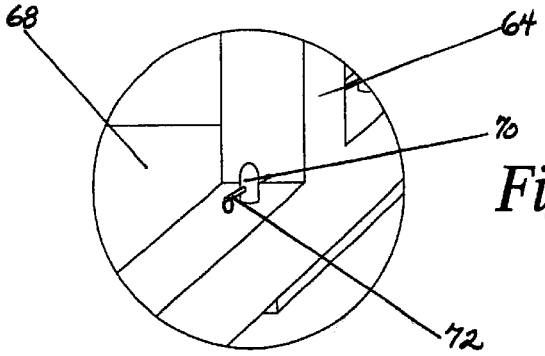
FIG. 18 is a detailed view from FIG. 17 indicating how the floor plate attaches to the weight rack.

A preferred weight rack 60 having a removably attached crossbar 20 is shown in FIGS. 14, 15, and 17. The weight rack 60 has two inverted T-shaped legs 62 and 64 which stand parallel to each other. The legs 62 and 64 include notches 66 along the upright portion of the inverted T-shaped legs, which accept the removably attached crossbar 20 and hold the crossbar 20 at the desired height. When the dumbbell device 8 is used with the preferred weight rack as shown in FIG. 15, a wide variety of flat surfaces can be used as a weight bench, as long as the surface is parallel to the ground, has a width that fits between the inverted T-shaped legs 62 and 64 of the weight rack 60, and can support the weightlifter. The weight rack 60 can include a floor plate 68 as shown in FIGS. 16–18. The floor plate can consist of any sturdy material that can withstand someone standing on it, such as any type of metal, including steel plate and aluminum. The floor plate 68 has four pin members 70 attached to it, as shown in FIG. 16. A pin member 70 is attached to each corner of the floor plate 68. Each inverted T-shaped leg 62 and 64 of the weight rack includes two holes 74 on the bottom part 80 and 82 of the leg 62 and 64. The two holes 74 are located so that the upright portion 76 and 78 of the inverted T-shaped leg 62 and 64 is positioned between the holes 74. The four holes 74 accept the four pin members 70 of the floor plate 68 as shown in FIGS. 17 and 18. Each of the four pin members 70 has a hole through the top so that each pin member 70 can receive a rod 72. When the floor plate 68 is attached to the weight rack 60, the rods 72 are slideably inserted through the pin members 70 to ensure the floor plate 68 remains attached to the weight rack 60. The floor plate 68 is used by a weight lifter to perform squats and other lower body exercises. The weight lifter stands on the floor plate and lifts at least one and preferably two dumbbell devices off of the crossbar of the weight rack. The weight lifter proceeds to hold the device at his or her side while performing lower body exercises on the floor plate of the weight rack.

Alternatively, the weight lifter can stand on the floor plate 68 while wearing the weight belt 38 of the invention. In this instance, the weight belt will hold the dumbbell devices 10 at the weight lifter's sides while the weight lifter performs lower body exercises such as lunges, calf raises, and squats on the floor plate. The preferred weight rack 60 can be easily disassembled for storage or travel by slideably removing the rods 72, removing the floor plate 68 and removing the crossbar 20.

Thus, there has been shown and described a dumbbell support device and system for using the same with a weight belt and a weight rack. It is apparent to those skilled in the art, however, that many changes, variations, modifications, and other uses and applications for the device and system are possible, and also such changes, variations, modifications, and other uses and applications, which do not depart from the spirit and scope of the invention, are deemed to be covered by the invention, which is limited only by the claims which follow.

What is claimed is:

1. A device for supporting a dumbbell, said device comprising;

(e) a frame, including two S-shaped members parallel to each other, and a perpendicular bar member attached to said S-shaped members;

(f) a strap located parallel to said perpendicular bar member and perpendicular across one end of said S-shaped members, said strap being removably attached to said S-shaped members of said frame, so that a dumbbell can be placed across said strap, and thereby be supported by said S-shaped members;

(g) a cushion tubularly encapsulating said perpendicular bar member;

(h) a second strap removably attached to the straight portion of each S-shaped member and parallel to said perpendicular bar member; and (i) a non-slip band removably attached to said perpendicular bar member, perpendicular to said bar member, and parallel to said S-shaped members, said band can be placed around a weight belt so that said device can hang from said weight belt.

2. A weight-lifting system comprising:

(a) a device for supporting a dumbbell, said device comprised of a steel frame, including two S-shaped members, parallel to each other, and a perpendicular bar member, integrally attached to one end of said S-shaped members, a leather strap, said strap located parallel to said perpendicular bar member and perpendicular to said S-shaped members, and removably attached to the end of said S-shaped members opposite the end where said perpendicular bar member is integrally attached, so that a dumbbell can be placed across said strap, and thereby be supported by said S-shaped members, a second strap removably attached to the straight portion of each S-shaped member, and parallel to said perpendicular bar member, a cushion tubularly encapsulating said perpendicular bar member, and a non-slip band removably attached to said perpendicular bar member, perpendicular to said bar member, and parallel to said S-shaped member;

(b) a weight belt having at least one unitary J-shaped member attached to said weight belt, wherein said unitary J-shaped member receives said device for supporting a dumbbell; and (c) a weight rack comprised of two inverted T-shaped legs parallel to each other; a crossbar removably attached to said inverted T-shaped legs, wherein said T-shaped legs further include a plurality of notches for receiving said removably attached crossbar; and a floor plate removably attached to the bottom of said inverted T-shaped legs.

* * * * *